US006503148B2

(12) United States Patent
Lane

(10) Patent No.: US 6,503,148 B2
(45) Date of Patent: Jan. 7, 2003

(54) GOLF SWING TRAINING DEVICE AND METHOD

(76) Inventor: Joseph Lane, 29 Silver Spring Park, Ridgefield, CT (US) 06877

( * ) Notice: Subject to any disclaimer, the term of this patent is extended or adjusted under 35 U.S.C. 154(b) by 0 days.

(21) Appl. No.: 09/825,695

(22) Filed: Apr. 4, 2001

(65) Prior Publication Data

US 2002/0173368 A1 Nov. 21, 2002

(51) Int. Cl.[7] ..... A63B 69/36
(52) U.S. Cl. ..... 473/215; 473/216
(58) Field of Search ..... 473/215, 216, 473/219, 226, 207, 208, 212, 227, 218, 266, 277

(56) References Cited

U.S. PATENT DOCUMENTS

| | | | | | |
|---|---|---|---|---|---|
| 2,777,697 | A | * | 1/1957 | Crossot | |
| 3,300,219 | A | * | 1/1967 | Sipos | |
| 4,239,228 | A | | 12/1980 | Norman et al. | 273/189 R |
| 4,245,841 | A | | 1/1981 | Owens, Jr. | 271/183 B |
| 4,399,994 | A | * | 8/1983 | Hourihan | |
| 4,479,653 | A | * | 10/1984 | Woodson | |
| 5,040,798 | A | | 8/1991 | Leitao | 273/183 B |
| 5,085,437 | A | | 2/1992 | Leitao | 273/183 B |
| 5,342,055 | A | * | 8/1994 | Diley | |
| 5,358,250 | A | | 10/1994 | Spencer | 273/187.2 |
| 5,441,271 | A | * | 8/1995 | Briggs | |
| 5,704,065 | A | * | 1/1998 | Feuerhake | |
| 5,718,640 | A | * | 2/1998 | Noblin | |
| D404,103 | S | * | 1/1999 | Winters | |
| 6,024,656 | A | | 2/2000 | Lane | 473/409 |
| 6,077,169 | A | * | 6/2000 | Florian | |
| 6,120,418 | A | * | 9/2000 | Plough | |
| 6,171,201 | B1 | * | 1/2001 | Tiller | |
| 6,270,430 | B1 | * | 8/2001 | Nicoloff | |

* cited by examiner

*Primary Examiner*—Paul T. Sewell
(74) *Attorney, Agent, or Firm*—St. Onge Steward Johnston & Reens

(57) ABSTRACT

A simple, golf swing training device and method of training which provides a lightweight, completely portable device for teaching and practicing a proper golf swing, and more particularly to a golf swing practice device and method to train a golfer to rotate his body throughout the golf swing and thereby train the body to know the feel of a correct golf swing by air swinging. The device comprises a rod of predetermined length and diameter having a distal end and a proximal end; a utility belt attached to the proximal end of the rod for positioning the rod on a golfer; a club receptacle attached to the distal end of the rod for receiving a golf club shaft, wherein the golf swing training device facilitates the training of the golfers body to know the feel of a correct golf swing.

18 Claims, 5 Drawing Sheets

GOLF SWING TRAINING DEVICE AND METHOD

FIELD OF THE INVENTION

This invention relates generally to devices for teaching and practicing a proper golf swing, and more particularly to a golf swing practice device and method to train a golfer to rotate his body throughout the golf swing and thereby train the body to know the feel of a correct golf swing by air swinging.

BACKGROUND OF THE INVENTION

Because a proper golf swing is such an unnatural movement, teaching the golfer the feel of a proper golf swing is a very difficult task. There are numerous golf swing training methods and devices presently available, as is well known to those skilled in the art of golf training, however, the use of such a method or device has not been heretofore proposed to solve the problems of teaching the proper feeling of a golf swing to a new golfer by air swinging, as we presently understand the prior art.

A number of such practice or training devices are related to engagement with, and movement control with respect to the waist area of the golfer. One such device is disclosed in U.S. Pat. No. 5,358,250 invented by Spencer. Another such device invented by Lopez is shown in U.S. Pat. No. 4,688,300. Other body or torso engaging golf swing practice or training devices are disclosed in the following U.S. Pat. Nos:

| | |
|---|---|
| Lane | 6,024,656 |
| Topping | 3,069,169 |
| Strong | 4,691,924 |

A number of additional prior art devices focus on interengagement with or between one or both arms of the user so as to correctively modify the arm movement during the practice golf swing. These patents are shown by example as follows:

| | |
|---|---|
| Davis | 1,655,092 |
| Vickers | 3,415,524 |
| Norman et al. | 4,239,228 |
| Owens | 4,245,841 |

To demonstrate the extremes to which golfers will go to improve the golf swing, Angshed, in U.S. Pat. No. 4,173,344, teaches a golf swing training device and method having an arcuate guide member which is generally circular in nature supported atop the ground by a ground-engaging frame and dimensioned and supported to extend along and control the entire path of travel of the golfer's hands through a fully executed golf swing.

The present invention provides an extremely simple to manufacture and easily carried and used device and method of use for teaching a golfer the feeling of a golf swing and for repeated practice thereof so that a golfer can learn to rotate his body around an axis by air swinging.

SUMMARY OF THE INVENTION

It is an object of the invention to provide a golf swing training device and method of training which provides a lightweight, completely portable device for teaching and practicing a proper golf swing, and more particularly to a golf swing practice device and method to train a golfer to rotate his body throughout the golf swing and thereby train the body to know the feel of a correct golf swing by air swinging.

In accordance with one embodiment of the invention, a golf swing training apparatus comprises a rod having a predetermined length and diameter; the rod has a distal end positioned away from the golfers body and a proximal end affixed to a utility belt. The utility belt is worn around the waist of the golfer and attaches the rod to the golfer while holding the rod in a substantially horizontal position substantially parallel to the ground. The belt is adjustable to ensure the comfortable fit of the utility belt, as well as support for positioning the rod horizontally. A club receptacle is placed at the distal end of the rod for receiving a golf club shaft. The golf swing training device facilitates the training of a golfer's body to know the feeling of a correct golf swing.

In preferred embodiments the substantially horizontal rod is further equipped with a cup which provides a resting place for the golfers elbow. The cup is typically positioned on top of the rod and immediately adjacent to the golfer's waist.

Preferred embodiments also allow for the rod to be adjustable in length. Such adjustable rods may be locked into a desired length by inserting pins into a plurality of holes found throughout the rod, or by known telescopic locking swivel means as typically found in utility poles or extension poles.

It is the object of this invention to provide a rod manufactured out of wood, metal, plastic, graphite or combinations of these materials.

It is the object of this invention to provide a utility belt, which is adjustable in length. The utility belt can be constructed from materials that one of skill in the art of making belts would use to make a belt, such as leather or nylon or any other synthetic material capable of making a web.

It is the object of this invention to provide a club receptacle attached to the distal end of the rod. The club receptacle is substantially hook shaped such that the opening forms a hook substantially forty-five degrees off of a vertical axis. Preferably the angle of the hook provides an opening that a golfer utilizing the device can back-swing a golf club and deposit the shaft into the club receptacle. Movement of the club in a horizontal plane will engage the club and the rod such that both devices move in unison throughout the remainder of the golf swing. Preferable the club receptacle is constructed from durable material such as plastic or metal. The club receptacle may be affixed to the rod by a screw or other attachment means, however the shaft and club receptacle can certainly be integrally formed by one of skill in the art of making rods or hooks, or molding.

It is the object of the present invention to provide a glove to be worn on the golfer's hand that lies immediately adjacent to or closest to the rod while utilizing the golf swing training device. Right-handed players typically wear the glove on the right hand, while left-handed players typically wear the glove on the left hand. Although the glove is typical of known golf gloves, it is distinguishable by the placement of a highly visible band or marker on the back of the glove for determining or indicating that the golfer has achieved the desired anterior club position after completion of the air swing. The marker typically extends along the first metacarpal bone.

It is the object of the present invention to provide a mat for positioning the golfer in a golf stance. The mat may be made of plastic or any durable material. The preferred mat will provide a centering line, as well as a foot outline so that a golfer utilizing the device can align himself in a golf stance.

A method of golf swing training in accordance with the invention comprises attaching a golf swing training device to a golfer's waist; providing a golf club having a grip, a shaft and a head; gripping the golf club; positioning the golfer in a golf stance such that the golf club head lies in a position substantially inferior and substantially anterior to said golfer; elevating the golf club such that the shaft is positioned substantially above the club receptacle and at a substantially lateral position distal from said golfer; depositing said shaft into the club receptacle, and swinging said club toward the midline of the golfer's body. The preferred method may additionally comprise observing a marker on the back of the golfer's hand or glove. The preferred method may also utilize a mat for aiding the golfer in obtaining the proper stance.

Another method of golf swing training in accordance with the invention comprises attaching a golf swing training device to a golfer's waist; gripping a golf club; attaining a golf stance substantially similar to addressing the ball or grounding the club; back swinging said golf club such that the club, hands, arms and body of the golfer move away from the teeup position creating potential energy to be delivered downward, outward and forward throughout the teeup position; depositing said golf club in the club receptacle such that the golf club becomes attached to the rod; and air swinging the golf club the golf club toward the midline of the golfer's body and wherein the golf training device misdirects the potential energy to be delivered downward, outward and forward through the air swing in a plane at an angle to or parallel to the ground. In the preferred embodiment this method allows the golfer to learn the feel of a proper golf swing. The golfer also learns how to rotate his upper body around an axis.

DETAILED DESCRIPTION OF THE INVENTION

Figure 1:
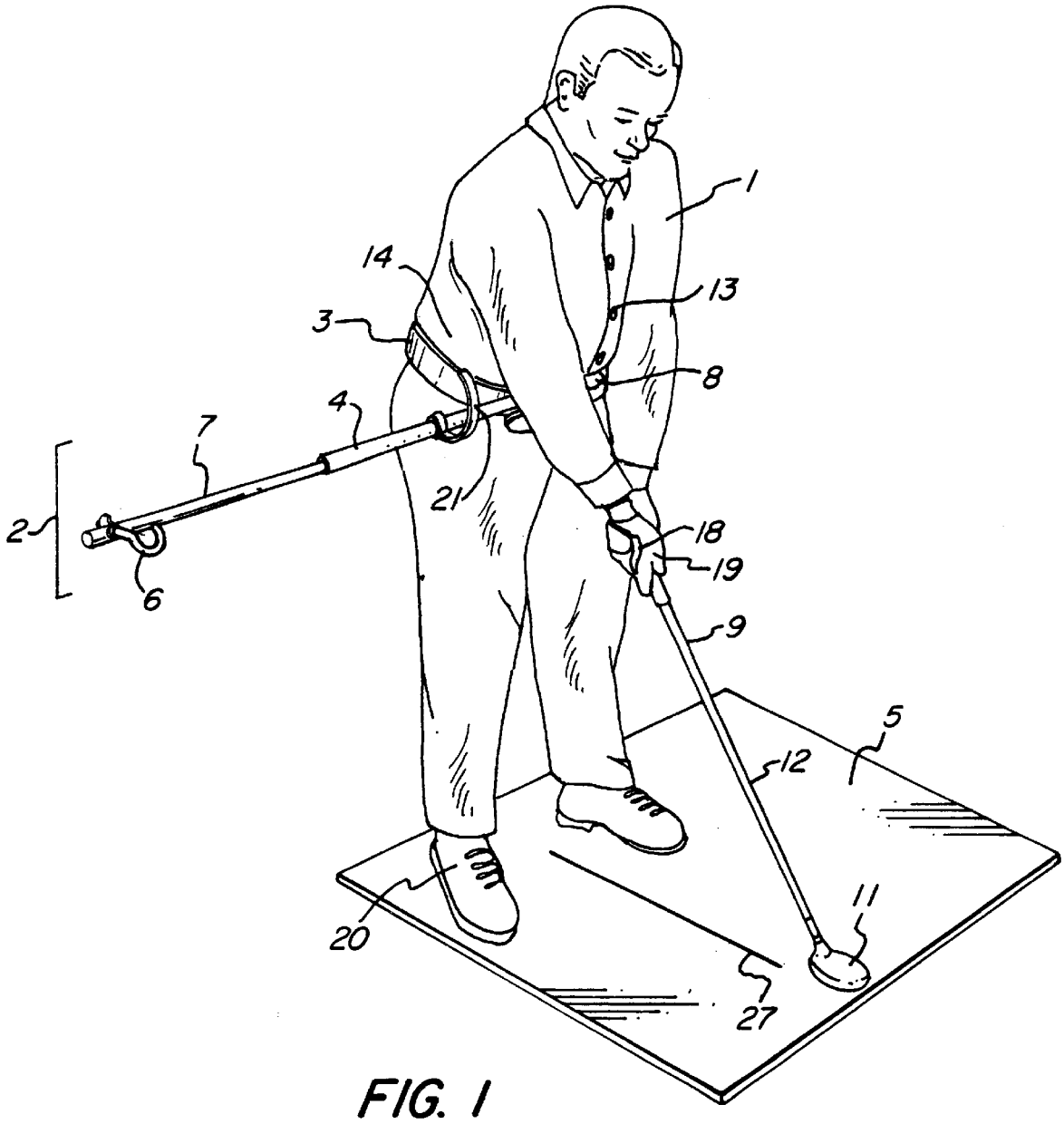
FIG. 1 is a perspective view showing a golfer wearing the device of FIG. 4 in a proper initial or address the ball stance or grounding the club stance.

Referring now to the drawings, and particularly to FIGS. 1–4, the preferred embodiment of the invention is shown generally at numeral (2) and includes a rod (4) having a predetermined length and diameter. Rod (4) is typically between 60 cm and 160 cm in length and maybe varied depending upon the size of the golfer. Optimally rod (4) is 125 cm in length for the average golfer (1) having a height of 180 cm. The diameter of rod (4) lies typically in the range of 1 cm to 4 cm, optimally about 2 cm. Rod (4) has a distal end (7) meaning that portion of rod (4) that is further away from golfer (1), and a proximal end (8) meaning that end of rod (4) that is closest to golfer (1).

In one embodiment of the invention, rod (4) is designed to be adjustable in length. Rod (4) is fabricated having varying diameters such that the distal end is thicker than the proximal end. Various sections are interconnected so that the rod (4) changes in length similar to a telescope or umbrella shaft. The adjustable rod (4) may be further locked into position by known rotating or locking means such that rod (4) will not change in length while being used by golfer (1). Rod (4) is typically constructed out of rigid durable materials such as wood, plastic, graphite, metal, or various combinations of these materials.

Affixed to rod (4) adjacent to proximal end (8) is utility belt (3). Utility belt (3) is worn around the waist of golfer (1) and is attached to rod (4) by at least one screw (22), or more preferably and in the alternative at least one rivet. Utilizing buckle (23) utility belt (3) is adjustable so that it may comfortable accommodate the waistline of golfer (1) in a range between 50 cm in circumference to 150 cm in circumference, optimally between 60 cm in circumference to 100 cm in circumference. Utility belt (3) supports rod (4) so that it extend away from golfer (1) in a substantially horizontal position as demonstrated in FIG. 1. Utility belt (3) may be made out of durable materials capable of supporting rod (4) in a horizontal position such as Nylon webbing, leather, or any material that one of skill in the art of making a belt would use.

Figure 4:
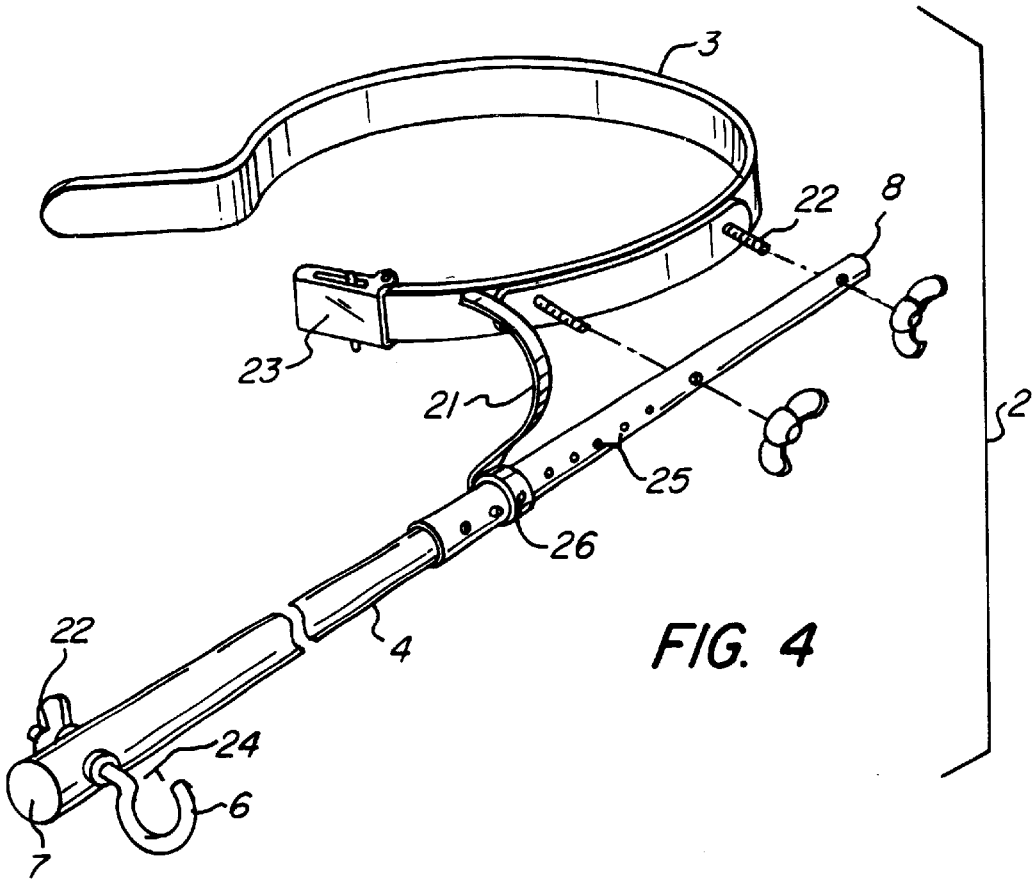
FIG. 4 is a top plan view of an obverse face of the preferred embodiment of the invention.

FIG. 4 shows club receptacle (6) located at the distal end (7) of rod (4) having an opening (24). Opening (24) is designed to receive golf club shaft (12) and is optimally designed in a hook shape such that opening (24) is approximately 35 degrees to 80 degrees off of a vertical axis, optimally 45 degrees off of a vertical axis. Club receptacle (6) is preferably constructed from durable material such as plastic or metal. Club receptacle (6) is typically affixed by at least one screw (22), however unibody construction of rod (4) and club receptacle (6) is a preferred design.

FIG. 4 further shows cup (21) positioned along rod (4). Cup (21) is designed to accommodate the golfers elbow (15) during the golf swing. Cup (21) may be manufactured out of any rigid material strong enough to support the weight of golfer's elbow (15) such as plastic. Cup (21) is typically positioned such that it lays immediately adjacent golfer's (1) "love handles" and/or waistline. In one preferred embodiment cup (21) may be attached to rod (4) by retaining loop (26). Retaining loop (26) allows the cup to be adjustable and placed in a variety of positions along rod (4). A plurality of holes (25) along rod (4) provide a lock and pin mechanism to affix cup (21) in the desired position.

Figure 5:
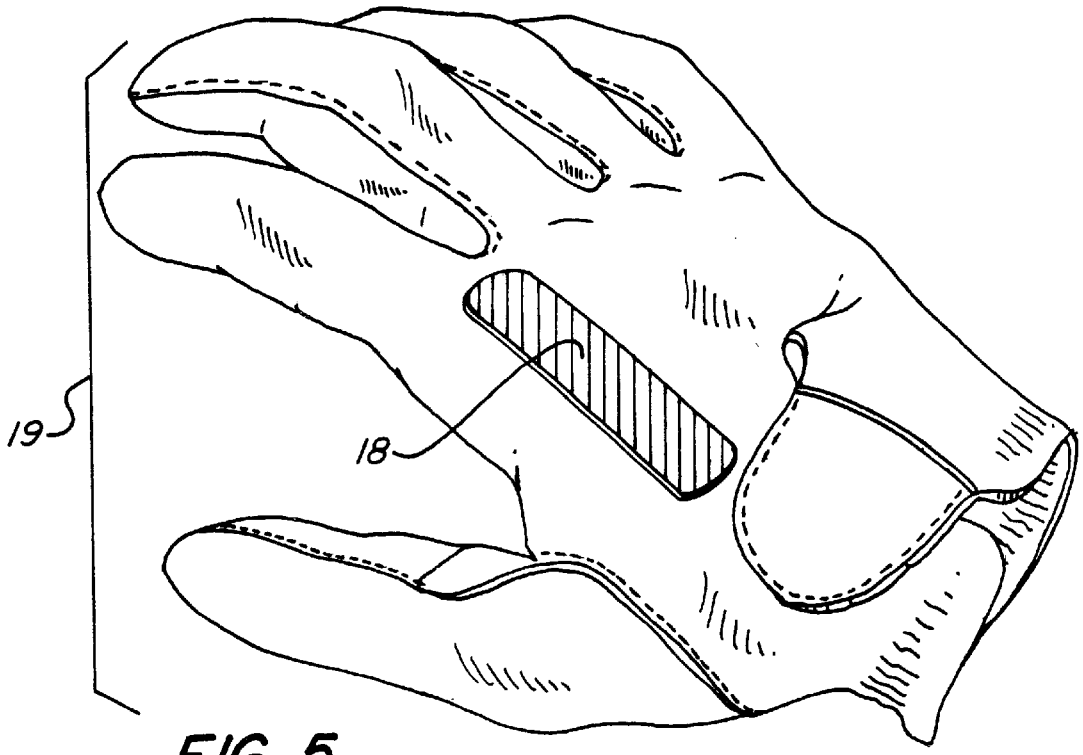
FIG. 5 is a top plan view of a glove embodiment of the invention.

FIG. 5 shows glove (19), which is used in one preferred embodiment of the invention. Glove (19) is typically worn by golfer (1) on the hand immediately adjacent to rod (4). Glove (19) is a typical golf glove distinguished only by a highly visible band or marker (18) on the back of glove (19). Marker (18) is located and extends along the back of the first metacarpal bone.

Figure 6:
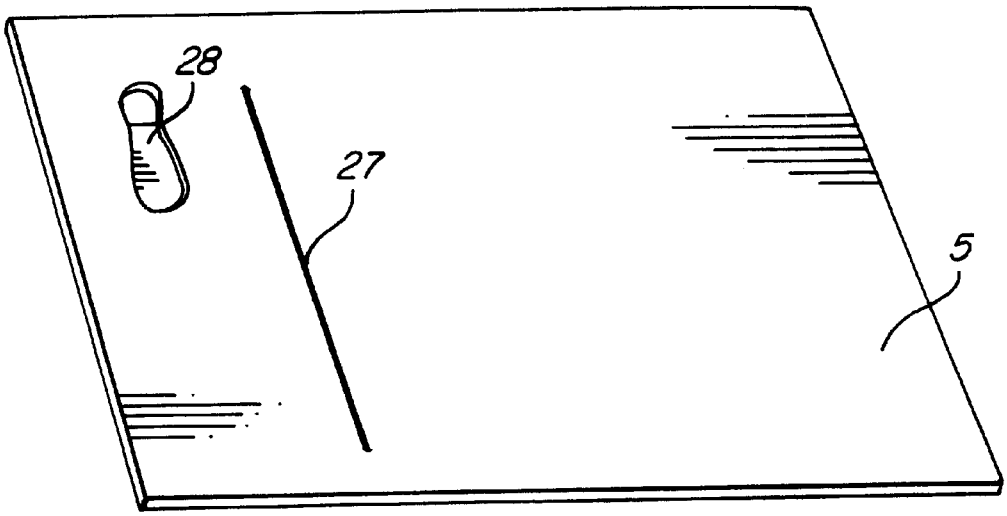
FIG. 6 is a top plan view of a mat for another embodiment of the invention.

FIG. 6 shows mat (5) used to position golfer (1) in a golf stance. Mat (5) contains a centering line (27) where golfer (1) will align golf club head (11). Adjacent to centering line (27) is foot outline (28) where golfer (1) will place his outside foot (20) in order to obtain a proper golf stance.

Figure 7:
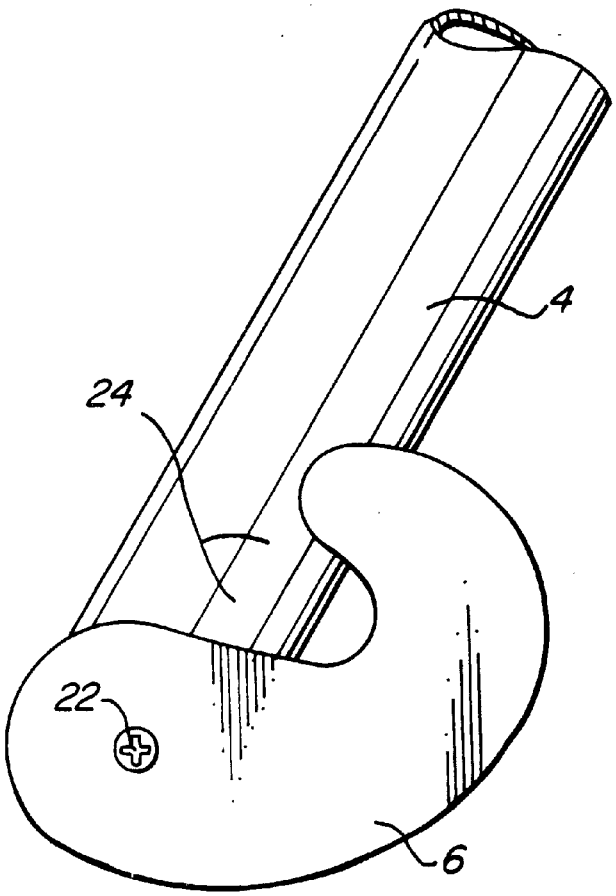
FIG. 7. is a side plan view of the preferred club receptacle.

Referring to FIG. 7, the preferred way to affix club receptacle (6) to rod (4) at distal end (7) is displayed. Club receptacle (6) is substantially hook shaped such that opening (24) forms a hook substantially forty-five degrees off of a vertical axis. Club receptacle (6) is made out of plastic and may be screwed into the most distal end of rod (4) with screw (22). Opening (24) is positioned posterior to rod (4) so that it can pull rod (4) through an air swing. This preferred embodiment facilitates golfer (1) with easy deposition of club shaft (12) into club receptacle (6), while effectively joining club shaft (12) to receptacle (6) for the remainder of the air swing, as well as easy removal of club shaft (12) from club receptacle (6), upon completion of the air swing.

Figure 2:
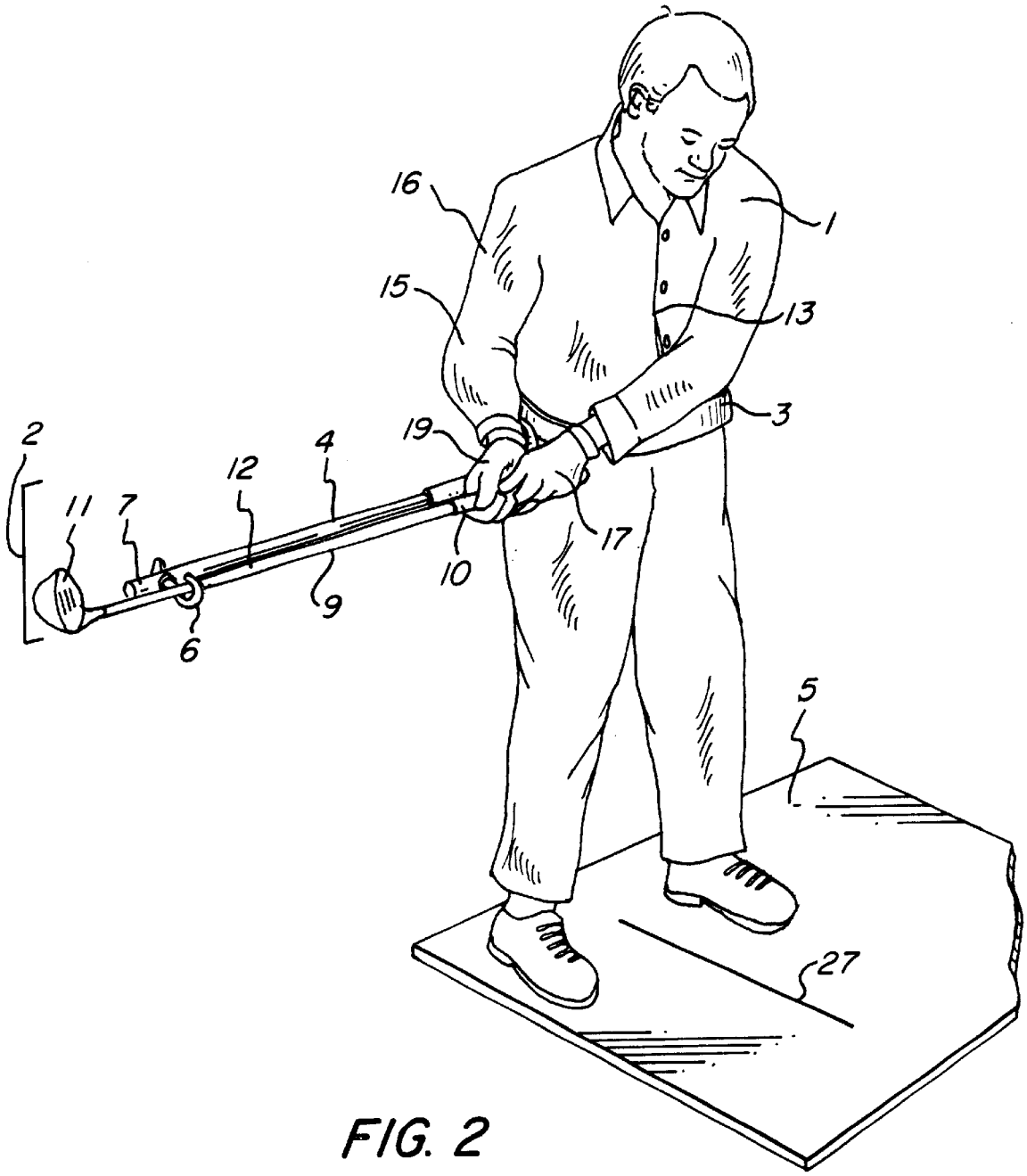
FIG. 2 is perspective view showing a golfer wearing the device of FIG. 4 showing the golfer at the top of the back swing in a lock position distal from the golfer after depositing the golf club shaft in the club receptacle.
Figure 3:
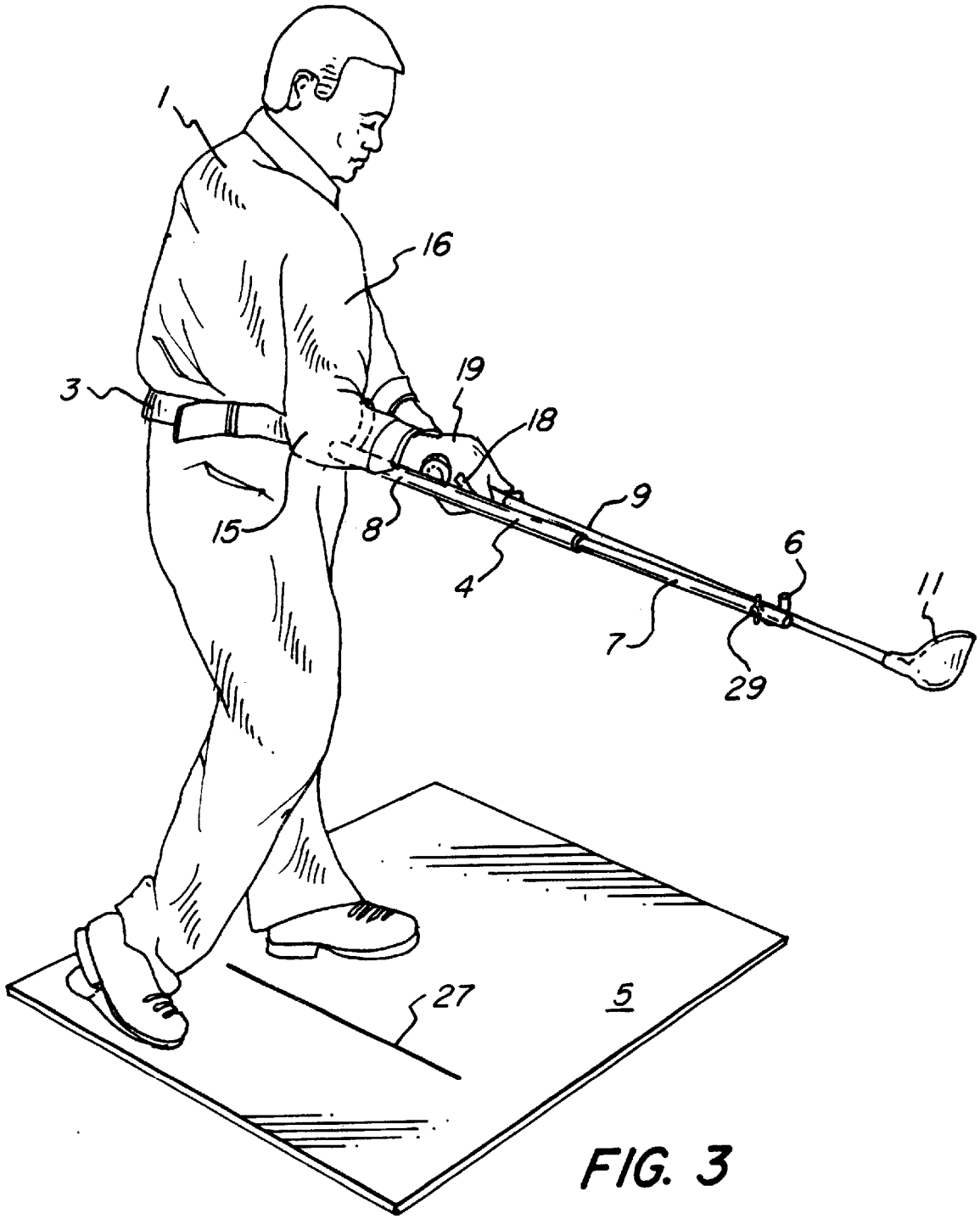
FIG. 3 is a perspective view similar to FIG. 1 showing the golfer at the end of the air swing.

Referring now to FIGS. 1, 2, and 3 the preferred embodiment of a method of training a golfer to rotate his body throughout the golf swing and thereby train the body to know the feel of a correct golf swing by air swinging is disclosed. FIG. 1 is a perspective view of golfer (1) wearing device in the initial golf stance. This stance is also called the teeup position, address the ball stance, or grounding the club stance and means that golfer (1) is taking a stance and getting ready as if to hit a golf ball, or the placement of a club head behind where a golf ball would be placed in an actual golf swing. Characteristic of this stance include golfer (1) holding golf club (9) such that golf club head (11) is placed inferior to golfer (1) meaning further from the head of golfer (1), and anterior to golfer (1) meaning placed towards the front of golfer (1). One embodiment including mat (5) includes positioning club head (11) along centering line (27).

FIG. 2 is perspective view showing golfer (1) wearing device (2) where golfer (1) is at the top of the back swing in a lock position substantially lateral and distal from golfer (1) after depositing golf club shaft (9) in club receptacle (6). Back swing means that golfer (1) has elevated golf club head (11) away from the teeup position and further includes displacing the club (9), hands (17), arms (16) and body (1) away from the teeup position creating potential energy to be delivered downward, outward and forward through the teeup position. Golfer (1) will typically backswing to the extent that club shaft (12) is positioned above club receptacle (6) and lateral to golfer (1). This enables golfer (1) to readily deposit club shaft (12) through opening (24) and into club receptacle (6). When club shaft (12) has entered opening (24) golf club (9) is in a locked position. Locked position means golf club (9) and rod (4) are substantially attached to one another such that when golfer (1) continues to moves golf club (9) in a forward direction anterior to golfer (1), such movement will be further directed by device (2).

FIG. 3 is perspective view showing golfer (1) after air swinging golf club (9). "Air swinging" means swinging golf club (9) toward the midline of golfer (13) in a plane substantially parallel to the ground or mat (5) or in a plane at a slight angle (e.g. an angle of 45 degrees or less) to such a plane parallel to the ground or mat. Air swinging is much different from a normal golf swing, in that golf club (9) is directed in a plane substantially parallel to the ground by device (2). Surprisingly, the air swing facilitates the training of a golfer (1) to rotate his body throughout the golf swing and thereby train golfer (1) to know the feel of a correct golf swing. FIG. 3 also shows golfer (1) looking at glove (19) at the end of the swing. Marker (18) is specifically designed and positioned such that if a golfer (1) can see marker (18) at the end of the golf swing, golfer (1) has a clear indication that the mechanics of the golf swing training method and device have correctly been performed and that golfer (1) can commit to memory the proper feeling of a correct golf swing, as well as proper golf swing body rotation. A simple substitute for marker (18) can be manufactured by drawing a distinguishable and visible line along the first metacarpal bone on the back of the hand.

It is to be appreciated that the foregoing is illustrative and not limiting of the invention, and that various changes and modifications to the preferred embodiments described above will be apparent to those skilled in the art. Such changes and modifications can be made without departing from the spirit and scope of the present invention, and it is therefore intended that such changes and modifications be covered by the following claims.

What is claimed is:

1. A method of golf swing training, comprising:

attaching a golf swing training device to a golfer's waist having a utility belt and a rod of predetermined length and diameter, such that said rod extends laterally from said utility belt from an anterior middle position of said golfer to a substantially lateral position substantially perpendicular to said golfer and substantially horizontal to the ground, said rod having a distal end and a club receptacle at said distal end of said rod;

providing a golf club having a grip, a shaft, and a head;

said golfer gripping said golf club;

positioning said golfer in a golf stance such that said golf club head lies in a position substantially inferior and substantially anterior to said golfer;

said golfer elevating said golf club such that said shaft is positioned substantially above said club receptacle and at a substantially lateral position distal from said golfer;

said golfer depositing said shaft into said club receptacle; and said golfer swinging said club toward the midline of the golfer's body.

2. The method of claim 1 further comprising observing a marker on back of said golfer's hand.

3. The method of claim 1 wherein the step of positioning said golfer in a golf stance further comprises utilizing a mat.

4. The method of claim 1 wherein the step of positioning said golfer in a golf stance further comprises depositing the golfer's elbow in a cup attached to said rod.

5. The method of practicing swinging a golf club, which comprises:

attaching a golf swing training device to a golfer's waist having a utility belt and a rod of predetermined length and diameter, such that said rod extends laterally from said utility belt from an anterior middle position of said golfer to a substantially lateral position substantially perpendicular to said golfer and substantially horizontal to the ground, said rod having a club receptacle at the distal end of said rod;

said golfer gripping a golf club having a grip, a shaft and a head;

said golfer attaining a golf stance substantially similar to addressing a ball or grounding a club;

said golfer back swinging said golf club such that the club, hands, arms and body move away from the teeup position creating the potential energy to be delivered downward, outward and forward through the tee up position;

said golfer depositing said golf club in the club receptacle such that said golf club become substantially attached to said rod; and said golfer air swinging said golf club wherein said golf swing training device directs the swing of said golf club toward the midline of the golfer's body in a plane substantially parallel to the ground or at a slight angle to a plane substantially parallel to the ground.

6. The method of claim 5 said golfer having an upper body, said method further comprising said golfer rotating said upper body around an axis.

7. A golf swing training device comprising:

a rod of predetermined length and diameter having a distal end and a proximal end;

a utility belt attached to said proximal end of said rod for positioning said rod on a golfer; such that said rod extends laterally from said utility belt from an anterior middle position of said golfer to a substantially lateral position substantially perpendicular to said golfer and substantially horizontal to the ground, said rod having a club receptacle at the distal end of said rod; and a club receptacle attached to said distal end of said rod for receiving a golf club shaft, wherein the golf swing training device facilitates the training of the golfers body to know the feel of a correct golf swing.

8. The golf swing training device in claim 7 further comprising a cup positioned on the top of said rod for providing a rest for the golfer's elbow.

9. The golf swing training device in claim 7 wherein said rod is adjustable in length.

10. The golf swing training device in claim 7 wherein said rod is constructed from material selected from the group consisting of metal, wood, graphite and plastic.

11. The golf swing training device in claim 7 wherein said utility belt is adjustable in length.

12. The golf swing training device in claim 7 wherein said utility belt is constructed from a material selected from the group consisting of nylon and leather.

13. The golf swing training device in claim 7 wherein said club receptacle is attached to said distal end of said rod such that the opening forms a hook shape forty-five degrees off vertical.

14. The golf swing training device in claim 7 wherein said club receptacle is made of material selected form the group consisting of plastic and metal.

15. The golf swing training device in claim 7 further comprising a glove.

16. The golf swing training device in claim 7 further comprising a glove, wherein said glove further comprises a marker on the back of said glove for determining the golfer's correct anterior club position.

17. The golf swing training device in claim 7 further comprising a mat for positioning said golfer in a golf stance.

18. The golf swing training device in claim 7 wherein said rod is attached to said utility belt by means of screws.

* * * * *